United States Patent [19]

Valenti

[11] Patent Number: 4,529,446

[45] Date of Patent: Jul. 16, 1985

[54] FORMED METAL-CONTAINING BRIQUETTES, PROCESS FOR FORMING THE SAME AND PROCESS FOR UTILIZING THE SAME IN THE MANUFACTURE OF STEEL

[76] Inventor: Nicholas Valenti, 1422 Som, Mayfield Heights, Ohio 44124

[21] Appl. No.: 566,854

[22] Filed: Dec. 29, 1983

Related U.S. Application Data

[63] Continuation of Ser. No. 371,871, Apr. 26, 1982, abandoned, which is a continuation of Ser. No. 235,402, Feb. 18, 1981, abandoned.

[51] Int. Cl.[3] ..... B22F 1/00

[52] U.S. Cl. ..... 75/256

[58] Field of Search ..... 75/256

[56] References Cited

U.S. PATENT DOCUMENTS 4,063,944 12/1977 Behring ..... 75/256

4,165,221 8/1979 Valenti ..... 75/42

*Primary Examiner*—Peter D. Rosenberg

*Attorney, Agent, or Firm*—Sughrue, Mion, Zinn, Macpeak, and Seas

[57] ABSTRACT

Formed metal-containing briquettes of high green strength, high shatter and good compressive strength in the cured state from a composition comprising a metal-containing waste, an aqueous solution comprising ammonium polyphosphate and magnesia. The product can be easily formed by mixing all components at room temperature, introducing the same into a mold and thereafter permitting the same to set. Setting is very rapid, and the product can be handled within minutes after molding. The product finds particular use as a replacement in whole or in part for metal sources in a steel-making process; it has the excellent advantages that the metal content thereof is extremely high and it introduces no harmful impurities into steel during steel making.

13 Claims, No Drawings

FORMED METAL-CONTAINING BRIQUETTES, PROCESS FOR FORMING THE SAME AND PROCESS FOR UTILIZING THE SAME IN THE MANUFACTURE OF STEEL

This is a continuation of application Ser. No. 371,871, filed Apr. 26, 1982, which is a continuation of application Ser. No. 235,402 filed Feb. 18, 1981, both abandoned.

BACKGROUND OF THE INVENTION

1. Field of the Invention

The present invention relates to formed metal briquettes, processes for forming the same and processes for utilizing the same in steel making.

2. Description of the Prior Art

Perhaps the most commonly used method of melting iron is through the use of a cupola wherein coke, a fluxing material such as limestone, and a metallic material are charged. The coke is ignited and air is blasted into the bottom of the cupola to generate intense heat, melting the metallic material, typically iron, which then trickles down through the fluxing material and the coke to the bottom of the cupola. A molten slag is formed on the top of the charge and typically comprises coke ash and similar materials. The coke used in the charge in most of such steel-making processes today is high-quality metallurgical grade coke which is produced by the distillation (in the absence of oxygen) of coal. While the metallic material is typically iron, it would be a great advantage to the industry if metal-containing waste materials as are typically generated in various manufacturing processes would be utilized as a source of metal in such processes. However, to date, the prior art has not provided any means of simply and economically converting metal-containing waste materials into a form which can be used in a process as above described without the use of harmful binders, without relatively low metal proportions which render the same uneconomical or without the generation of fine particles of metal and like materials which can be harmful to the process.

U.S. Pat. No. 4,179,283 Rehder discloses metal oxide-carbon compacts for reduction and combustion in various types of furnaces. Rehder contemplates the mandatory use of two specific types of carbon, a substantial limitation on the formulation of the Rehder metal oxide-carbon compacts. Further, Rehder does not contemplate the use of metals as is the case per the present invention. Finally, the binder systems disclosed in Rehder are totally dissimilar from those of the present invention. To my best knowledge, the Rehder metal oxide-carbon compact has not been commercially used.

U.S. Pat. No. 3,832,158 Obenchain discloses a process for producing metal from metal oxide pellets in a cupola-type vessel. In a manner similar to Rehder, Obenchain admixes a metal oxide and a carbonaceous material. While Obenchain suggest that a binder may be present, the only binders disclosed are cementitious materials, which binders are quite dissimilar from those of the present invention.

U.S. Pat. No. 3,156,557 Dahl et al discloses aggregates of ore, a carbonaceous reducing agent, a flux and a cementitious binder. Dahl et al is seen to be cumulative to Rehder and Obenchain and subject to the defects thereof.

Many other processes are also known wherein metal or metal oxides in crude form are processed to final product form, for example, the reduction of chrome concentrates, oxides or ores to ferro-chrome, the reduction of manganese ores to ferro-manganese and the like, and it would be a substantial benefit in such processes if chrome or manganese-containing waste materials could be processed therein.

U.S. Pat. No. 4,165,221 Valenti discloses carbon-containing briquettes which are formed from a composition comprising carbon, magnesia and an aqueous ammonium polyphosphate solution.

SUMMARY OF THE INVENTION

The present invention relates to a metal-containing briquette possessing unique characteristics for supplementing, in part, the metal-containing charge to various processes such as in a foundry, in a blast furnance, in other steel-making applications and in the production of various other types of metals, which metal-containing briquette is formed by a simple process.

In more detail, one object of the present invention is to provide a metal-containing briquette which permits waste materials generated during various manufacturing processes to be efficiently and economically utilized, which waste materials currently have no substantial use.

A second object of the present invention is to provide a metal-containing briquette which has excellent green strength and can be handled safely with minimal breakage within minutes after molding the same.

A third object of the present invention is to provide metal-containing briquettes which possess excellent shatter and compressive strength.

Yet another object of the present invention is to provide metal-containing briquettes which can be used as part of a cupola charge and which have the characteristics which render them compatible with the charge to the cupola.

Yet a further object of the present invention is to provide a metal-containing briquette for use in a steel-making process such as a foundry, blast furnace and/or other steel-making process, which contains high proportions of metal and low proportions of binder.

Yet another object of this invention is to provide a metal-containing briquette for use in a steel-making process which introduces substantially no detrimental impurities into the resultant steel and which yields lessened amounts of slag contributing products.

A further object of the present invention is to provide a simple process for forming such metal-containing briquettes, which process can be practiced at ambient temperature with or without compressive molding and without the need for high-temperature curing with simplified apparatus.

A secondary object of the present invention is to provide metal-containing briquettes as above described which can be utilized in the reduction of chrome concentrates and other chromium sources such as chrome oxide or chrome ore to ferro-chrome, for reducing manganese ores to ferro-manganese, and in like processes where the metal therein can be used as part of the feed to the process.

A final object of the present invention is to provide a steel-making process using metal-containing briquettes as above described.

The metal-containing briquettes of the present invention are formed from a mixture comprising one or more metal-containing materials, typically one or more metal-containing waste materials, magnesia and an aqueous solution comprising one or more ammonium polyphosphates.

The process of the present invention simply comprises mixing the three components identified, substantially immediately pouring the resulting mixture into a mold, permitting the same to sit for a few minutes at ambient temperature or at an elevated temperature if desired, and thereafter removing the same from the mold. In an optimal embodiment, the mixture can be subjected to compressive molding, if desired.

The steel-making process of the present invention is substantially equivalent to conventional steel-making processes, except that the charge thereto can be supplemented by the metal-containing briquette of the present invention.

DESCRIPTION OF THE PREFERRED EMBODIMENT

Hereafter, all percentages, parts and like figures are by weight, unless otherwise indicated.

Product Aspects

As indicated, the metal-containing briquettes of the present invention are formed from a composition which includes the following essential components: a metal-containing material, magnesia and an aqueous ammonium polyphosphate solution. In a most preferred, and highly economic embodiment of the present invention, the metal-containing material is a waste material.

The Metal-Containing Material

As one skilled in the art will appreciate, the metal-containing material utilized in forming the briquette of the present invention can come from various sources. However, for practical purposes, the present invention finds most substantial application in the use of metal-containing waste materials which do not have substantial use. Thus, the present invention not only provides a valuable supplement to various steel-making and similar processes, but it permits a heretofore useless material to be economically utilized. Accordingly, hereafter, the metal-containing material utilized to form the briquettes of the present invention will be discussed in the context of a metal-containing waste material, though the present invention is not per se limited to such.

Essentially any metals used in steel-making and like processes can be utilized to form the briquette of the present invention. For example, waste cast iron, waste steel including stainless steel and related materials can be used to form the briquette of the present invention which can then be used in a cupola, blast furnace or in an electric melt furnace.

Specifically, the metal-containing waste material used to form the briquette of the present invention includes mill scale, filter cake, blast furnace dust, pellet fines, taconite fines, taconite per se, open hearth dust, powdered iron ore, electric furnace dust, metal filings in any form, metal turnings and metal borings in any form, chrome oxide, chrome ores, manganese ores, etc. Simply stated, the present invention relates to the use of metals and/or metal oxides in any form that can be briquetted and will find use in steel-making and similar processes. As will be appreciated by one skilled in the art, the term "metal-containing material" as used herein includes, metal-containing, metal oxide-containing and metal- and metal-oxide containing materials.

I have found in a preferred embodiment that metal filings as are produced as a waste product in the machining of cast iron, e.g., in the milling of cast iron engine blocks, are useful in the present invention. Such filings often will have a wide size range including relatively large metal filings down to very fine almost hair-like filings, and such can be used herein.

While not limitative as a critical parameter, typically, the metal-containing materials used herein will comprise particles or filings having a size of about 2 inches or less. Larger particles, of course, could be used herein, but generally such are useful per se as a steel-making charge and are not economical in the present invention. The minimum size of the metal-containing waste is not important since the present invention can be practiced even with dust-like materials. Commonly, the metal-containing waste will comprise a mixture of particles having a size of from 2 inches minus or smaller with 1 inch minus or smaller metal-containing materials being more commonly available.

It is not necessary that the metal-containing waste used in the present invention be treated in any special fashion prior to forming the metal-containing briquettes of the present invention, i.e., it can be used directly as a waste material from various machining procedures. I have found, however, that materials which are heavily coated with oil are not amenable to processing per the present invention, and if such are to be utilized the oil should be substantially removed prior to formation into a briquette per the present invention.

While as I have indicated all of the above materials are useful metal-containing materials per the present invention, I wish to maintain a line of distinction between materials such as taconite and mill scale and materials such as metal borings and the like, i.e., a line of distinction between oxide materials and metal materials. In the situation where a metal oxide-containing material is used as the waste material to form the briquette of the present invention the reaction in steel-making and like processes utilized is a chemical reaction. In distinction, when a metal material such as a filiing, boring or the like is utilized there is no chemical reaction, rather, the metal, typically iron in the metal-containing waste material, merely remelts. In the former situation, carbon is mandatory whereas in the latter situation carbon is optional.

The Magnesia

The magnesia used in the present invention serves as a source of magnesium oxide. It does not enter into the steel-making process but assists in permitting the aqueous ammonium polyphosphate to set up to serve as a binder. Thus, there is no particular limitation on the particle size of the magnesia so long as it presents sufficient surface area, either by being of a relatively fine size and/or through adequate mixing, to set the aqueous ammonium polyphosphate solution. The magnesia can, if desired, be of a substantially uniform size or have a particle size range down to dust-like powder. I have found that magnesia of $\frac{3}{8}$ inch minus functions well in the present invention, and, hence, such is preferred, but this is not limitative as the magnesia particle size is selected to provide desired density and other properties in the metal-containing briquette.

The magnesia used in the present invention can be pure MgO, but this is not preferred or necessary. More typically and preferably, it is in the form of highly calcined or dead-burned magnesite of a fine particle size, or may be calcined dolomite having a substantial magnesia content. What is important at this point of the invention is that any such particulate magnesium oxide source be capable of reacting with the phosphates to produce a bonded structure. Impurities, i.e., non-MgO materials, as are commonly found in the above-identified commercially available industrial materials have not to date been found to be harmful (typical impurities are CaO, $SiO_2$, $Al_2O_3$, $Fe_2O_3$—this latter material is, of course per se useful in steel-making and related processes but typically is present only in very minor proportions as a trace or like amount impurity). I prefer, however, that any calcined or dead-burned magnesite or calcined dolomite have an MgO content of at least about 80%, more preferably about 87% or greater, though this is not mandatory. While the above magnesia materials can be used alone or as mixtures thereof, I most prefer to use dead-burned magnesite as the magnesium oxide source.

Hereafter, for brevity, I will merely use the term "magnesia" to generically refer to all of the above materials which serve as a source of MgO for ammonium polyphosphate setting.

The Ammonium Polyphosphate

The ammonium polyphosphate of the present invention is used in aqueous form.

Ammonium polyphosphate materials as described in U.S. Pat. Nos. 3,879,209, Limes et al., and 4,059,455, Limes et al., both hereby incorporated by reference, can be used with success in the present invention, though the present invention is not limited thereto.

The strength or concentration of ammonium polyphosphate in the aqueous ammonium polyphosphate solution of the present invention is not overly important so long as sufficient ammonium polyphosphate is present in the metal-containing briquette of the present invention to serve its binding function in combination with the magnesia.

Typically, aqueous ammonium polyphosphate solutions as are commercially available have a 30% or higher phosphate concentration, e.g., 30–37%, by weight, phosphate, and such are preferably used in this invention. The water content of such commercial aqueous ammonium polyphosphate solutions is typically about 50%, balance impurities, though water content is not especially limited so long as the necessary amount of phosphates can be put into solution. Nothing is gained by excessive water being present, and little need has presented itself to date to either dilute or concentrate such commercially available aqueous ammonium polyphosphate solutions, though I may occasionally dilute to increase the plasticity of the mixture being briquetted.

It is preferred in accordance with the present invention that of all phosphates present in the aqueous ammonium polyphosphate solution of the present invention, at least about 20%, by weight, be polyphosphates, and it is most preferred that at least 60%, by weight, of all phosphates present, be polyphosphates. The polyphosphates are typically principally pyrophosphate with minor higher polyphosphates, such as tripolyphosphates and higher phosphates, and can be essentially all pyrophosphate. The balance of the phosphates present is typically orthophosphate, in many cases it being preferred that 30–40% orthophosphate, based on all phosphates present, be used. Thus, in a most highly preferred form of the invention, the aqueous ammonium polyphosphate solution comprises about 50% water, 30–37% ammonium phosphates (which break down to 70–80% ammonium polyphosphates—pyrophosphate or higher—and 20–30% ammonium orthophosphate), balance inert impurities. The exact nature of the ammonium polyphosphate is not important so long as it is in the pyrophosphate form or higher.

For certain embodiments, the aqueous ammonium polyphosphate solution used is a mixture of the ortho-, pyro- and poly- (tri and higher) forms with at least 20%, by weight, pyro-/poly-forms where at least 2%, by weight, are in the poly-form. In all embodiments, of course, the active phosphates are in the ammonium form. Typically, the aqueous ammonium polyphosphate solution comprises about 8–12% ammoniacal nitrogen.

Product Proportions

The amounts of the essential components, i.e., the metal-containing waste material(s), aqueous solution of ammonium polyphosphate(s) and magnesia are as follows.

Aqueous solution of ammonium polyphosphates

For this section, I merely refer to the above component as the "solution." Further, since the phosphate proportion is more easily expressed as parts of $P_2O_5$, that parameter is used herein.

The solution is used in an amount to provide at least about 1 part of $P_2O_5$ per 100 parts of magnesia and metal-containing waste.

However at amounts of solution providing only about 1 part $P_2O_5$, it is possible higher temperatures and compression will be needed to form a good metal-containing briquette. Thus, I prefer to use an amount of the solution which will provide at least about 3 parts $P_2O_5$ per 100 parts metal-containing waste material and magnesia, and have found superior product characteristics using the solution in an amount to provide about 3 parts $P_2O_5$ per 100 parts metal-containing waste material and magnesia.

The maximum amount of the solution used is less critical than the minimum from the viewpoint of insuring an effective binding function, but if too high a proportion is used, the metal-containing waste briquette takes on a glassy sheen, indicating excess solution is present. Thus, a simple test to determine excessive solution is whether the metal-containing briquette presents a glassy, reflective surface as opposed to a dull, non-reflective surface. The exact amount of solution preferably used depends on the amount of magnesia and the particle or filing size of the magnesia and metal-containing waste, but I believe that best results are encountered during use if the solution provides no more than about 10 parts $P_2O_5$ per 100 parts of metal-containing waste and magnesia. Since I find lesser parts $P_2O_5$ to be very satisfactory, I see no current need to use such higher proportions of the solution, the most expensive component of the metal-containing briquette, though such could probably be used with very exacting control of the setting (curing) conditions.

Magnesia

The magnesia should comprise at least about 1%, by weight, of the metal-containing waste material, and to avoid the need for excessive mixing prior to setting, I prefer to insure that the magnesia comprises about 9% to about 12% of the metal-containing waste material. While such high proportions of magnesia are not theoretically required, they permit me to conduct mixing without having to pay critical control to either mixing intensity or time or magnesia particle size and still obtain useful product. I believe that if I used finely divided magnesia and/or intense expensive or long-term mixing, I could achieve the same results with low magnesia percentages as with higher since I would insure high phosphate/magnesia contact.

Higher proportions of magnesia can be used, of course. For example, it does not seem that high magnesia proportions have any harmful effect on the metal-containing briquette, but since magnesia has a cost much higher than the metal-containing waste material, the use of higher amounts thereof tends to defeat one important object of a preferred embodiment of the invention, i.e., to enable large amounts of a current waste material such as metal filings to be used in steel-making processes.

Simply stated, the minimum proportion of magnesia is important to insure good, easy bonding with the aqueous solution of ammonium polyphosphate(s), but the maximum amount thereof seems to be more economically oriented, i.e., after an amount sufficient for bonding with the solution is present, the excess does not assist bonding, remains inert at use and, very importantly, displaces metal-containing waste material, which is not only needed in the use of the metal-containing briquette but is of very low cost. For example, amounts of magnesia up to, e.g., 20% by weight, or higher, provide bonding but undesirably lower the metal-containing waste content and increase cost unnecessarily.

Metal-containing Waste Material(s)

The one or more metal-containing waste materials comprise the balance of the metal-containing briquette.

Additives

The present invention does not exclude the use of additives. These are optional in this invention and are conventional, i.e., you can use conventional metallurgical coke or coal, e.g., coke breeze additives as desired, e.g., to increase the carbon content or ease metal-containing briquette processing as desired. This emphasizes the essential nature of the metal-containing briquette of this invention. Unless the additive adds to the essential nature of the steel-making process, I prefer to use low amounts thereof, e.g., less than about 10%. The fixed carbon content can be brought to a higher specified carbon level with a carbon increaser such as a high carbon ground, such as C-coal or petroleum coke. However, it should be understood that such additives are optional herein. Further, of course, limestone can be present in the briquette of the present invention in amounts as desired since limestone serves as an excellent flux material in steel-making and related processes.

Processing Conditions

The process of the present invention in its basic form is simple. The metal-containing waste, magnesia and aqueous ammonium polyphosphate solution are mixed in the proportions earlier recited, substantially immediately placed into a mold and then permitted to set therein for a few minutes, typically at least about 3 minutes.

The conditions selected for mixing are not overly important so long as the metal-containing waste, magnesia and aqueous ammonium polyphosphate solution are well mixed, most desirably uniformly dispersed throughout the composition. Mixing in theory can take only a few seconds, and is conducted in a conventional manner. Usually I mix for at least about 1 minute to ensure good dispersion.

The time after the completion of mixing to introduction into the mold is not critical in the sense that it must be done within seconds, but since the composition begins to set once the aqueous ammonium polyphosphate solution and magnesia contact each other, one should not delay in introducing the composition into the desired mold after setting has excessively proceeded since in this case molding cannot be conducted. The time involved is a matter of common sense, and typically upon the completion of mixing I thereafter substantially immediately introduce the composition into the desired mold.

While I have found that at ambient conditions setting in the mold for typically a period of about 3 minutes is sufficient, if the composition is permitted to set in the mold for a longer period the metal-containing briquette will gain additional strength.

Mixing and setting (curing) can be conducted at ambient or at elevated temperature. If at ambient temperature, somewhat longer setting times are required during the winter with shorter setting times being required during the summer. For safety, at ambient temperature I usually permit the composition to set for at least about 2 minutes and seldom have found it necessary to permit the composition to set for more than about 5 minutes. The metal-containing briquettes can, at that stage, be safely handled since they quickly illustrate excellent green strength.

The general rule I have found is that increasing the temperature of setting decreases the time required for the briquettes to illustrate excellent green strength. With commercial heating apparatus I have found that elevated temperatures on the order of 325° F. to 475° F. are easily attained, whereby one can set the fuel briquettes of the present invention in less that about 2 minutes.

The elevated temperatures for setting (curing) can be obtained using any conventional apparatus, for instance, infrared heaters, propane heaters, other types of gas heaters, and the like. Devices providing higher or lower heating temperatures can be used, of course, but lower temperatures do not speed setting much over ambient and the complexity of higher temperature operation is essentially unfavored.

Quite often I initially set at ambient for, e.g., at least about 2 minutes, and then follow with a brief "post-setting" at a higher temperature, e.g., at about 325° F.–475° F. This speeds processing and appears to provide an initial product with higher green strength.

Often it is convenient to compress the setting mixture just after introduction into the mold. Since the setting composition is plastic during the initial period of setting (curing), compression appears to slightly increase the density of the metal-containing briquette and make the same somewhat easier to handle.

In more detail, prior to substantial setting of the fuel briquette of the present invention in the mold, preferably a compressive force is applied thereto. Since the setting composition is plastic during the initial period of setting (curing), compression increases the density of the metal-containing briquette and makes the same easier to handle and use. In theory, I can compress during the initial stage when setting is beginning. However, care must be taken to insure that excessive pressure is not applied to a set briquette. Thus, for practical reasons I merely momentarily apply pressure to the mixture in the mold prior to the initiation of any substantial degree of setting, which achieves the results I desire, and thereafter remove the pressure. By proceeding in this fashion I do not have to be overly concerned with compressive rupture of a rapidly setting (or set) system, rather, I merely compact a plastic system which in a short period of time will be set.

Compression can be by any conventional means, and for certain uses compression by an amount equivalent to hand tamping is sufficient. However, I have found that for certain uses it is most preferred to compress the setting mixture under pressure beyond those achievable by hand-tamping, i.e., to use mechanical compression.

What I desire to achieve by using compression of any type during setting is basically to increase the density of the final briquette as compared to an uncompressed briquette. It appears, based on results to date, that compression brings all components of the setting mixture into closer, more intimate contact and increases the final strength of the briquette, not only for purposes of handling but in addition increases the ability of the briquette to better withstand conditions of use in the manufacture of steel or iron, e.g., in blast furnace or cupola use, since I encounter lesser breakage of small particles from the briquette during use thereof in a blast furnace or cupola.

Generally, any compressive forces tend to increase the durability of the briquette in blast furnace or cupola processing due to reduced breakage, but the effect of compressions during setting for this purpose is especially pronounced at high pressures on the order of about 1000 lb/in$^2$ or more at present I prefer to use pressures of at least about 1300 lb/in$^2$ during setting, though I have noted a lesser effect of increased durability at lower pressures. For example, I currently apply a pressure of 1280 lb/in$^2$ on my current preferred composition and apparatus.

At present, after mixing the binder system and metal-containing waste material, I introduce the composition, prior to setting, into a closed mold and apply a pressure as indicated above to the top of the setting mixture using a rectangular plate and a hydraulically activated piston.

The exact minimum and maximum compressive force applied during setting will depend on a number of factors which can be balanced by one skilled in the art, as I now explain.

First, the compression should be sufficient to bring the metal-containing particles or filings into close, intimate contact. Since I often find a small amount of the binder to ooze to the surface of the mixture during compression setting, I believe I am compacting to an extent to increase the number of surface to surface contacts between the metal-containing particles or filings, whereby I achieve better binding.

Secondly, the compressive force should be sufficient to avoid any substantial proportion of what I call "super voids" in the metal-containing briquette, i.e., voids larger than the metal-containing particles or filings. If these voids fill with binder, I do not achieve a maximum binder utilization, which is disadvantageous. While I do not have the analytical equipment to exactly determine porosity, I estimate a good compacted metal-containing briquette comprises on the order of 25% air space. This appears, at present, to provide an excellent product without excess breakage of small particles. In most cases, based on my experience to date, I find that application of a compressive force to reduce final briquette density to a value on the order of about 60% to about 85% of the density of an uncompacted briquette provides very good results.

In summary, if I apply compressive force to the setting mixture to get good contact between the metal-containing waste materials and binder, I find I obtain reduced small particle break-off during briquette use.

Typically, compression is applied substantially simultaneously with introduction, i.e., just after introduction. Conveniently, considering the apparatus I now use for compressive molding, the mixture is introduced into the mold and, immediately or after a second or two, pressure is applied to the setting mixture. Compression should, of course, be applied before the mixture has had an opportunity to substantially cure or set, since once the binder system hardens compressive force may shatter or crush the same. This is generally no problem if compression is applied shortly after introduction into a mold.

The total time of compression is not overly important, i.e., once the desired pressure is applied for a time sufficient to achieve the desired degree of compaction the pressure can be removed. Alternatively, the pressure can be maintained until setting is substantially completed or beyond the time setting is completed, but I currently see no benefits to be achieved by extended compression beyond the time required for setting, and unless critical attention is paid to the pressure applied, I could crumble or shatter the briquette.

While the term "mold" has been used herein, this term is not limited to a classical mold per se but includes other apparatus capable of performing a molding or forming function, which may also be used for the application of compressive force. For example, an open or closed mold can be used with a hydraulic ram disposed thereover to apply force to the setting mixture or any equivalent apparatus can be used. For example, to mold a briquette of a 5"×5" cross-sectional area (25 sq$^2$), an applied ram pressure of 32,000 lbs provides an excellent product.

While the above operation is a batch operation, and my experience is limited to such, continuous molding should be possible with appropriate conventional mixing any feed apparatus.

The size of the metal-containing briquette is not especially limited except that the briquette should not be so large that it is not easily handled. Briquettes about the size of a conventional concrete block are easily fabricated and handled, however.

Having thus generally described the present invention, the following example of the currently preferred best mode of practicing the present invention is offered.

EXAMPLE 1

The metal-containing waste material utilized comprised filings taken from a cast iron engine boring operation which had a size from $-\frac{1}{8}$" to $-200$ mesh.

The magnesia selected was dead-burned magnesite. It had a random particle size distribution such that 100% passed $\frac{3}{8}$" minus, the particles ranging from just past $\frac{3}{8}$" mesh to fine powder. Its chemical composition was as follows (all percentages are weight percentages):

MgO: 87.3%
$SiO_2$: 4.6%
CaO: 4.2%
$Fe_2O_3$: 2.7%
$Al_2O_3$: 1.2%

It was a commercially available product from Basic Refractories under the name BRI Magnesite DB-87.

The aqueous ammonium polyphosphate solution comprised 50% water. The total $P_2O_5$ was 34.0 weight percent. Of the total $P_2O_5$ present, 72.0 weight percent was polyphosphate. The balance of the solution was impurities. The solution was available under the name Tgreen Solution 10-34-0 from Texas Gulf, Inc. According to their analysis the specific gravity at 75° F. is 1,395, pH is 5.95, and the apparent Brookfield viscosity at 40° F. is 80 cp. For purposes of the present invention, the only important parameters are total $P_2O_5$ and polyphosphate of the $P_2O_5$. Total nitrogen was 10 wt. %.

Using the above components, I firstly mixed 16 pounds of the metal filings with 12 ounces of the magnesia in a conventional mixing apparatus having a vertically oriented stirrer.

I then added 12 ounces of the aqueous-ammonium polyphosphate solution along with 4 ounces of water to increase the plasticity of the mixture, and vigorously mixed all components for one minute in the same apparatus until the mixture gained plasticity.

I then placed the resulting mixture into an open rectangular mold (surface area 25 $in^2$) and applied a pressure of 1,280 $lb/in^2$ to the surface of the briquette.

In this process run, after two minutes in the mold at ambient temperature, I thereafter removed the pressure and heated the briquette at 475° F. for two minutes while the same was in the mold. The briquette was then removed from the mold.

The briquette had sufficient green strength to be easily handled without breakage upon removal from the mold and was about the size of a loaf of bread.

STEEL-MAKING ASPECTS OF THE PRESENT INVENTION

As earlier indicated, the briquette of the present invention finds particular use as a supplement to the charge in a conventional steel-making process, such as in a blast furnace or other reduction process, in a foundry cupola, etc. Such processes are so well known that no further discussion is believed necessary. The present invention modifies such processes merely by supplementing the charge conventionally used therein with the briquette of the present invention; no other changes of substance are needed since the briquette of the present invention essentially retains the product characteristics of the metal-containing waste material from which it is formed. The minor amount of ammonium polyphosphate binder does not adversely affect these basic characteristics, and permits the briquette of this invention to be used in layerd form.

While not limitative, illustrative of blast-furnace operations wherein the briquette of the present invention finds use as a supplement are those described in U.S. Pat. Nos. 3,537,841 Wendel, 3,522,034 Bailey, 3,239,331 Menk et al., etc.

While the invention has been described in detail and with reference to specific embodiments thereof, it will be apparent to one skilled in the art that various changes and modifications can be made therein without departing from the spirit and scope thereof.

What is claimed is:

1. A metal-containing briquette formed from a composition comprising one or more metal-containing waste materials, magnesia and an aqueous ammonium polyphosphate solution, said magnesia and aqueous ammonium polyphosphate solution being present in an amount effective to bind said metal-containing waste material into said fuel briquette form.

2. The fuel briquette of claim 1, wherein said aqueous ammonium polyphosphate solution comprises ammonium orthophosphate and one or more ammonium polyphosphate.

3. The fuel briquette of claim 2, wherein said polyphosphates comprise at least 20 wt. % of the total phosphate present.

4. The metal-containing briquette of claim 3, wherein said polyphosphates comprise at least 60 wt. % of the total phosphate present.

5. The metal-containing briquette of claim 3, wherein said aqueous solution of ammonium polyphosphate comprises at least about 30 wt. % phosphates.

6. The metal-containing briquette of claim 2, wherein said phosphates provide an amount of phosphate of at least about 1 part as $P_2O_5$ based on 100 parts of said metal-containing waste material and magnesia.

7. The briquette of claim 6, wherein said amount is at least about 3 parts as $P_2O_5$, same basis.

8. The fuel briquette of claim 1, wherein said magnesia is present in said composition in an amount of at least 1 wt. % based on composition weight.

9. The fuel briquette of claim 8, wherein said magnesia is selected from the group consisting of calcined magnesia, dead-burned magnesia and calcined dolomite.

10. The fuel briquette of claim 8, wherein said magnesia comprises at least about 80 wt. % MgO.

11. A process for making a metal-containing briquette which comprises blending one or more metal-containing waste materials, magnesia and an aqueous ammonium polyphosphate solution, said magnesia and aqueous ammonium polyphosphate solution being present in an amount effective to act as a binder for said metal-containing waste material, and thereafter curing said binder.

12. The metal-containing briquette of claim 1, wherein the metal-containing waste materials is selected from the group consisting of mill scale, filter cake, blast furnace dust, pellet fines, taconite fines, taconite, open hearth dust, powdered iron ore, electric furnace dust, metal filings, metal turnings, metal borings, chrome oxide, chrome ores, manganese ores and mixtures thereof.

13. The metal-containing briquette of claim 1, wherein the metal-containing waste material contains at least metal filings.

* * * * *